United States Patent [19]

Brewer

[11] 4,402,848

[45] Sep. 6, 1983

[54] BAR OF SOAP

[76] Inventor: Alex T. Brewer, 1506 Amarillo Dr., Carpentersville, Ill. 60110

[21] Appl. No.: 385,925

[22] Filed: Jun. 7, 1982

[51] Int. Cl.[3] ..... C11D 17/00

[52] U.S. Cl. ..... 252/134; 252/90; 252/174; 252/DIG. 16

[58] Field of Search ..... 252/90, 134, 174, DIG. 16

[56] References Cited

U.S. PATENT DOCUMENTS

| | | | |
|---|---|---|---|
| 1,495,978 | 6/1924 | Anderson | 252/134 |
| 2,271,959 | 2/1942 | Swanson | 252/134 |
| 3,925,225 | 12/1955 | Morrison | 252/134 |

FOREIGN PATENT DOCUMENTS

| | | |
|---|---|---|
| 883184 | 7/1953 | Fed. Rep. of Germany . |
| 2654392 | 6/1978 | Fed. Rep. of Germany . |
| 989940 | 9/1951 | France . |

*Primary Examiner*—John E. Kittle
*Assistant Examiner*—Hoa Van Le
*Attorney, Agent, or Firm*—Robert V. Jambor

[57] ABSTRACT

Disclosed is a bar of soap having a recess in one side thereof and at least one projection extending outwardly from the recess. At least one opening is formed from the opposite side in alignment with the projection. As the bar of soap is used and portions dissolved, the bar becomes smaller and smaller and the opening becomes larger. At the point when the bar of soap is almost consumed, it will fit into the recess of a new bar of such soap and the opening in the used bar will coincide and engage the projection on the new bar. In this manner, the thin pieces of used soap are pressed into a new bar of soap thereby permitting complete consumption of each bar of soap used.

13 Claims, 5 Drawing Figures

BAR OF SOAP

BACKGROUND OF THE INVENTION

1. Field of the Invention

The present invention relates to bars of hand soap, and more particularly, to bars adapted to allow for complete consumption of unused portions.

2. Description of the Prior Art

Typically soap bars for bathing are generally rectangular having the length greater than the thickness and a thickness somewhat greater than the width. However, soap bars of circular or other shapes are also well known.

One of the common problems with conventional soap bars is that as the bar is used and dissolved, it becomes smaller and less convenient for use. Typically, the remaining sliver ultimately becomes so thin and small that it is difficult to grasp. Such small dissolved unused portions are usually thrown away resulting in the cumulative waste of substantial amounts of soap each year.

Thus, it would be a significant advance in the art to provide a bar of soap that allows complete consumption of the bar of soap without waste.

BRIEF DESCRIPTION OF THE INVENTION

A bar of soap in accordance with the present invention may be of conventional, generally rectangular, shape with relatively parallel faces on opposite sides of the bar, the particular overall shape is not important to the invention. The inventive bar includes a recess at one of the faces defined by a depressed surface and at least one integrally formed projection extending outwardly from that surface within the recess. At least one opening is formed inwardly of the bar from the opposite side. It is in general alignment with the projection and has sufficient depth that, as the bar wears, the remaining sliver will include an aperture defined by this opening.

As the bar of soap is used it dissolves to a size that will fit into the recess in a face of another, new, bar of soap. The unused portion of the used bar of soap is placed in the recess of the new bar. The aperture defined by the opening in the used bar is sized such as to tightly engage the projection in the recess of the new bar thereby retaining the used sliver or remnant of soap in the recess of the new bar. Use of the new bar with the affixed used bar remnant will result in substantially complete use of the remnant. Thereafter a wearing away of the new bar will result until it too, forms a sliver or remnant to be affixed to yet another unused bar.

To assure that the opening in the remnant portion of the bar of soap will tightly engage the projection on a new bar, the opening may be formed so that it is smaller than the minimum diameter of the projection. To facilitate retention of the used dissolved bar of soap in the recess, the projections may have ribs formed thereon to assist in gripping the used bar.

Thus, it is a principal objective of the present invention to provide an improved bar of soap that permits for complete utilization of the entire bar.

It is yet a further object of the present invention to provide an improved bar of soap which when unused, is adapted to receive and retain a remnant for a used bar, and which as it dissolves through use, forms a shape that may be received and held in a recess of a new, unused bar.

These and other objects, advantages and features shall hereinafter appear, and for the purposes of illustration, but not for limitation, an exemplary embodiment of the present invention is illustrated in the accompanying drawings.

DETAILED DESCRIPTION OF THE PREFERRED EMBODIMENT

Figure 1:
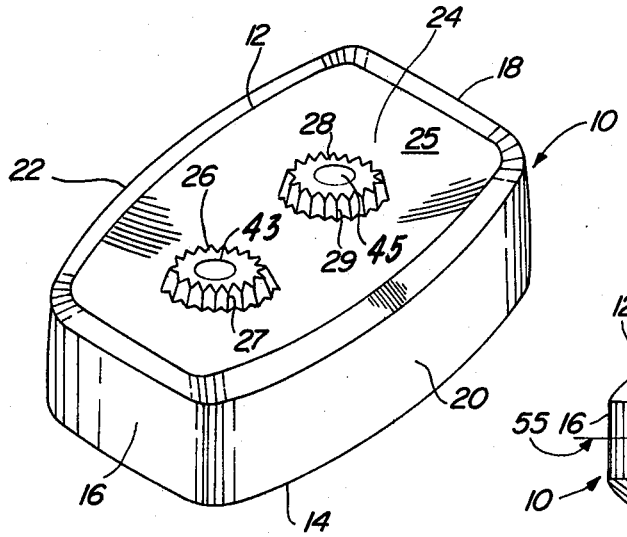
FIG. 1 is an upper right perspective view of a new bar of soap in accordance with the present invention.

With reference to FIG. 1, bar of soap 10 is of generally rectangular shape having length, width and thickness. The two largest side surfaces of the bar comprise upper and lower faces 12 and 14. Ends 16 and 18 and sides 20 and 22 join to form an essentially rectangular bar of soap.

Formed in the upper face 12 is a recess or depression 24 with a perimeter slightly smaller than the exterior dimensions of the perimeter of face 12. It is defined by recessed surface 25.

In the illustrated embodiment there are two projections 26 and 28 extending upwardly from the surface 25 of recess 24. The projections 26 and 28 are illustrated in the form of truncated cones and include ribs 27 and 29 around their exterior surfaces. Top surfaces 31 and 33 are spaced approximately equidistant from the center of the bar as is the opposite face 14. The center is identified by line 55 in FIG. 3.

Figure 2:
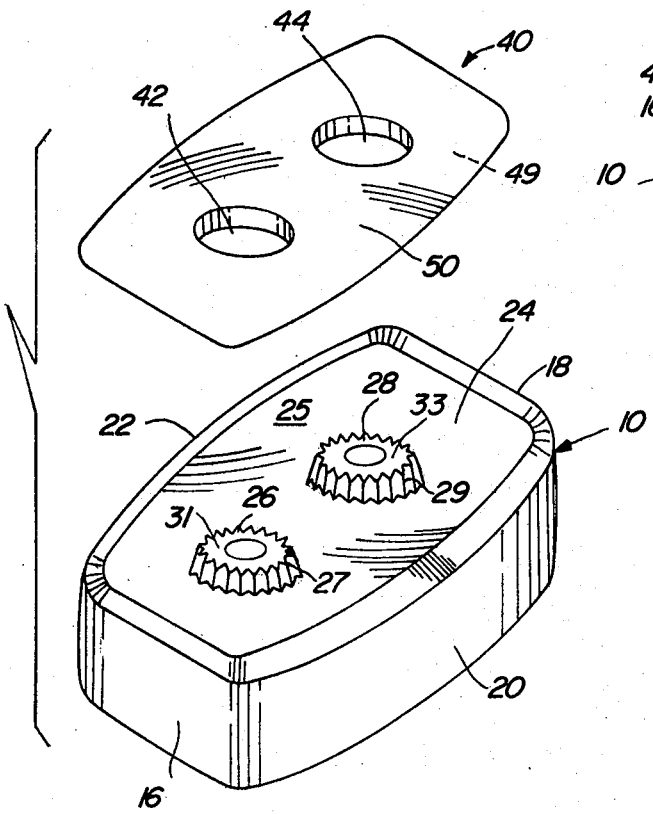
FIG. 2 is a right upper perspective view of the new bar of soap of FIG. 1 and a remnant or sliver of a used bar of soap also in accordance with the present invention, and prior to the used bar of soap being placed in the recess of the new bar of soap.
Figure 4:
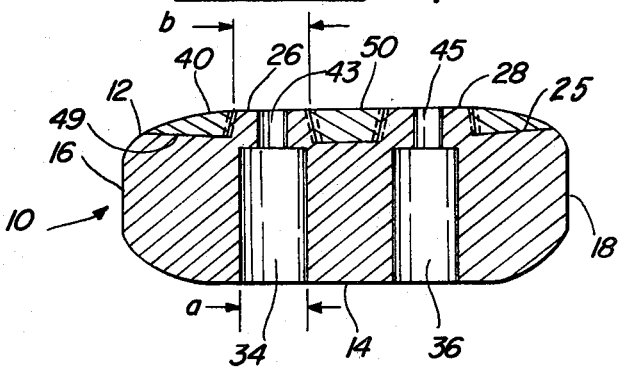
FIG. 4 is a cross sectional view of the bar of soap in FIG. 3.

With reference to FIG. 4, the bar includes generally cylindrical openings 34 and 36 extending inwardly of the bar from the opposite face 14. As illustrated, the openings 34 and 36 are generally aligned with projections 26 and 28. They extend inwardly of the bar a sufficient distance such that, as the bar is used, it wears to form a remnant or sliver 40. As best seen in FIG. 2, openings 34 and 36 then define two apertures 42 and 44. The openings 34 and 36 extend beyond center 55, and nearly the entire thickness of the bar. They terminate just below the base of the projections 26 and 28, a distance of about $\frac{1}{8}$ to $\frac{1}{4}$ inch below surface 25.

Smaller holes 43 and 45 are provided through the projections which communicate with the openings 34 and 36. These openings permit drainage of openings 34 and 36 in the event the bar is placed in a soap tray with the openings 34 and 36 facing upwardly. They permit entrapped water to drain from the openings to preclude possible adverse affect on the size of the resultant aperatures 42 and 44.

With reference to FIG. 2, it is understood that the used bar 40 was originally identical to bar 10 but after long use has been dissolved to a remnant as shown. Used bar of soap 40 has apertures 42 and 44 which result from openings 34 and 36 of the bar 10 after the bar has been dissolved through substantial use.

Figure 3:
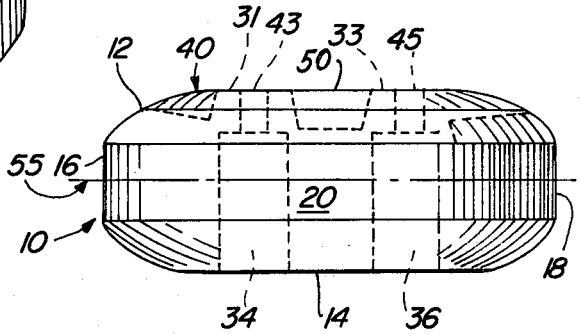
FIG. 3 is a side view of the bars of soap illustrated in FIG. 2 after a used bar is inserted into the recess.

Ultimately, after prolonged use, used bar 40 becomes small enough to be received in recess 24 and openings 42 and 44 are large enough that the used bar of soap can be inserted into recess 24 in bar 10 as illustrated in FIGS. 3 and 4. Openings 42 and 44 engage projections 26 and 28 and the ribs 27 and 29 formed in the sides of projections 26 and 28 to help engage openings 42 and 44. One surface 49 of remnant 40 rests against the surface 25, and due to the presence of moisture and the normal qualities of the soap composition, adheres to it. Since the sliver 40 substantially fills the recess 24, opposite surface 50 of the remnant, defines the outer peripheral surface of the soap bar. The composite bar thus formed of the sliver or remnant 40 and a new or unused bar 10 exhibits a shape of a conventional whole bar saver for the openings 34 and 36 and openings 43 and 45.

To insure a tight fit of the apertures 42 and 44 defined in remnant 40, the cylindrical openings 34 and 36 are formed with an internal diameter "a" shown in FIG. 4 which is slightly smaller than the diameter "b" across the ribs 27–29 at the small end of the truncated conical projections 26 and 28. A tight fit or grip is thus assured between openings 42–44 and projection 26–28.

Thus, as may be seen, recess 24 serves to receive the remnant of the preceding bar of soap after it is used and becomes small enough. The projections 26 and 28 act to engage the openings 42 and 44 to help to prevent the used bar 40 from falling out, twisting, or slipping out of the recess 24. If used bar 40 is dampened, it will become soft and adhere to recess 24 and projections 26 and 28 so that a single bar of soap may be formed and used. This assures that the used bar 40 is completely consumed.

Figure 5:
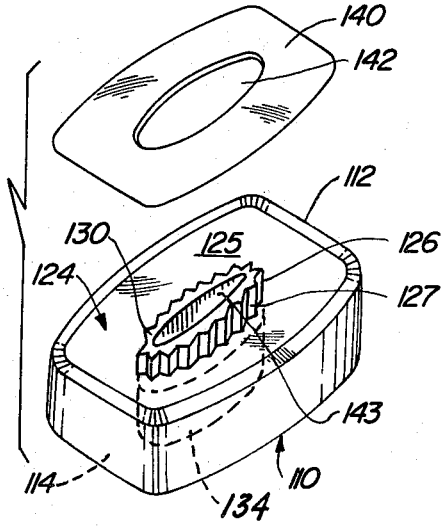
FIG. 5 is a perspective view of a slightly modified form of the invention.

Referring to FIG. 5, a slightly modified form of the invention is illustrated. A bar 110 includes an upper and lower face 112 and 114. The upper face has a depression or recess 124 defined by surface 125. An elongated projection 126 having ribs 127 is provided within the recess. It includes an upper surface 130 approximately equidistant from the center of the bar as is the opposite face 114.

The bar 110 defines an elongated opening 134 which extends into the bar from face 114 to within about $\frac{1}{8}$–$\frac{1}{4}$ inch from recessed surface 125, in alignment with projection 126. As the bar wears to form sliver 140, opening 134 forms opening 142 adapted to engage the projection 126 on another bar. Drain opening 143 is also provided to clear apperture 134 of any entrapped water.

It should be apparent from the preferred embodiment illustrated herein that various changes, alterations and modifications including the shape of the bar, number of projections, etc., may be made without departing from the spirit and scope of the present invention as claimed in the appended claims.

I claim:

1. A bar of soap having spaced apart faces on opposite sides of the bar,
   (a) a recess defined by a depressed surface formed in one of said faces,
   (b) at least one projection extending outwardly from said recessed surface, within said recess,
   (c) said bar defining at least one aperture extending inwardly of said bar from said face opposite said face having said recess, with said at least one aperture in alignment with said projection.

2. A bar of soap as claimed in claim 1 wherein said at least one projection is generally in the shape of a truncated cone.

3. A bar of soap as claimed in claim 2 wherein said at least one projection includes ridges formed upon the conical surface thereof.

4. A bar of soap as claimed in claim 2 wherein said projection is a truncated cone and said aperture is of an inside diameter slightly smaller than the minimum outside diameter of said projection.

5. A bar of soap as claimed in claim 1 wherein said at least one projection defines a hole in communication with said at least one aperture.

6. A bar of soap as claimed in claim 1 wherein said bar includes two such projections and defines one aperture in alignment with each one of said projections.

7. A bar of soap as claimed in claim 6 wherein said projections are in the form of truncated cones with the maximum diameter thereof adjacent said recessed surface, and said apertures are formed on an inside diameter slightly smaller than the minimum diameter of said projections.

8. A bar of soap as claimed in claim 7 wherein said projections include ridges formed upon the conical surfaces.

9. A bar of soap as claimed in claim 7 wherein said apertures extend inwardly from said surface from which they extend more than half the thickness of said bar.

10. A bar of soap as claimed in claim 7 wherein said projections define holes communicating with said respective aligned apertures.

11. A composite bar of soap including a bar having spaced apart faces on opposite sides of the bar,
   (a) a recess defined by a depressed surface formed in one of said faces,
   (b) at least one projection extending outwardly from said recessed surface, within said recess,
   (c) said bar defining at least one aperture extending inwardly of said bar from said face opposite said face having said recess, with said at least one aperture being in alignment with said projection, and a soap remnant formed of a used bar of soap defining opposite spaced apart faces and at least one aperture formed therethrough, one of said surfaces of said remnant overlying and contacting said recessed surface with said aperture of said remnant surrounding and engaging said projection, and the other of said surfaces of said remnant defining an outer surface of said composite bar.

12. A method of forming a composite bar of soap, the steps including, providing a soap bar having spaced apart faces on opposite sides of the bar,
   (a) a recess defined by a depressed surface formed in one of said faces,
   (b) at least one projection extending outwardly from said recessed surface, within said recess,
   (c) said bar defining at least one aperture extending inwardly of said bar from said face opposite said face having said recess, with said at least one aperture being in alignment with said projection, providing a soap remnant formed of a used bar of soap defining opposite spaced apart faces and at least one aperture formed therethrough, connecting said remnant to said bar with one of said surfaces of said remnant overlying and contacting said recessed surface of said bar with said aperture of said remnant surrounding and engaging said projection, and the other of said surfaces of said remnant defining an outer surface of said composite bar.

13. A bar of soap as claimed in claim 1 wherein said at least one projection is elongated and said at least one aperture is similarly shaped.

* * * * *